US007449125B2

(12) United States Patent
Church et al.

(10) Patent No.: US 7,449,125 B2
(45) Date of Patent: Nov. 11, 2008

(54) INSULATION WITH MIXTURE OF FIBERGLASS AND CELLULOSE

(75) Inventors: Joseph T. Church, Collierville, TN (US); Gary E. Romes, Cincinnati, OH (US)

(73) Assignee: Guardian Fiberglass, Inc., Auburn Hills, MI (US)

( * ) Notice: Subject to any disclaimer, the term of this patent is extended or adjusted under 35 U.S.C. 154(b) by 766 days.

(21) Appl. No.: 10/849,529

(22) Filed: May 20, 2004

(65) Prior Publication Data

US 2005/0279963 A1 Dec. 22, 2005

(51) Int. Cl.

| | |
|---|---|
| ***F16L 59/00*** | (2006.01) |
| ***F16L 59/02*** | (2006.01) |
| ***F16L 59/04*** | (2006.01) |
| ***E04B 1/62*** | (2006.01) |
| ***E04B 1/74*** | (2006.01) |

(52) U.S. Cl. ..... 252/62; 52/404.1; 52/742.1; 52/742.13; 106/204.3; 162/146; 427/421.1; 428/357; 428/364; 428/392

(58) Field of Classification Search ..... 252/62; 427/421.1; 106/204.3; 52/404.1, 742.1, 52/742.13; 162/146; 428/357, 364, 392
See application file for complete search history.

(56) References Cited

U.S. PATENT DOCUMENTS

| | | | | |
|---|---|---|---|---|
| 3,149,030 | A * | 9/1964 | De Lisle | 424/412 |
| 4,134,242 | A * | 1/1979 | Musz et al. | 52/309.1 |
| 4,351,867 | A | 9/1982 | Mulvey et al. | |
| 4,419,256 | A | 12/1983 | Loomis | |
| 4,468,336 | A * | 8/1984 | Smith | 252/62 |
| 4,579,592 | A | 4/1986 | Loomis | |
| 4,773,960 | A * | 9/1988 | Vincelli et al. | 156/357 |
| 5,236,757 | A * | 8/1993 | Probst et al. | 428/70 |
| 5,318,844 | A * | 6/1994 | Brandon | 428/357 |
| 5,516,580 | A | 5/1996 | Frenette et al. | |
| 5,641,368 | A | 6/1997 | Romes et al. | |
| 5,666,780 | A | 9/1997 | Romes et al. | |
| 5,683,810 | A * | 11/1997 | Babbitt et al. | 428/370 |
| 5,693,304 | A * | 12/1997 | von Rehren Borgstedt et al. | 423/332 |
| 5,717,012 | A | 2/1998 | Bondoc et al. | |
| 5,776,841 | A | 7/1998 | Bondoc et al. | |
| 5,921,055 | A * | 7/1999 | Romes et al. | 52/742.13 |
| 5,947,646 | A * | 9/1999 | Lytle | 406/48 |
| 5,952,418 | A | 9/1999 | Romes et al. | |
| 5,961,686 | A | 10/1999 | Chenoweth | |
| 5,983,586 | A | 11/1999 | Berdan, II et al. | |
| 6,012,263 | A | 1/2000 | Church et al. | |
| 6,047,518 | A | 4/2000 | Lytle | |
| 6,136,216 | A | 10/2000 | Fidler et al. | |
| 6,262,164 | B1 * | 7/2001 | Church et al. | 524/494 |
| 6,641,749 | B2 | 11/2003 | Rood | |
| 6,641,750 | B2 | 11/2003 | Rood | |
| 6,732,960 | B2 * | 5/2004 | Shaw et al. | 239/690 |
| 2003/0087576 | A1 | 5/2003 | Yang et al. | |

* cited by examiner

*Primary Examiner*—Anthony J Green
(74) *Attorney, Agent, or Firm*—Nixon & Vanderhye P.C.

(57) ABSTRACT

Certain example embodiments of this invention relate to insulation (e.g., loose-fill insulation which may be blown into attics, wall cavities, or the like) including a mixture of fiberglass and cellulose. In certain example embodiments, the insulation mixture comprises from 15-60% cellulose, more preferably from 20-50% cellulose, and most preferably from 25-45% cellulose (with substantially the remainder of the insulation be made up of fiberglass). Example advantages include improved radiant barrier properties and thus improve R-values/inch.

10 Claims, 1 Drawing Sheet

INSULATION WITH MIXTURE OF FIBERGLASS AND CELLULOSE

This invention relates to insulation (e.g., loose-fill insulation which may be blown into attics, wall cavities, or the like) comprising a mixture of fiberglass and cellulose insulations. In certain example embodiments of this invention, the insulation mixture comprises from 15-60% cellulose, more preferably from 20-50% cellulose, and most preferably from 25-45% cellulose (with substantially the remainder of the insulation being made up of fiberglass).

BACKGROUND OF THE INVENTION

Loose-fill insulation made of fiberglass is known in the art. For example, see commonly owned U.S. Pat. Nos. 6,047,518, 6,012,263, 5,952,418, 5,666,780 and 5,641,368, the disclosures of which are all hereby incorporated herein by reference. Fiberglass loose-fill insulation is typically blown and/or sprayed into attics or wall cavities as discussed in the aforesaid patents. When blown into attic cavities or areas, fiberglass loose-fill insulation typically has a density of about 0.40 to 0.55 lbs./ft$^3$.

While fiberglass loose-fill insulation is an excellent product and works well for its intended purpose, it does have a drawback relating to radiant barrier characteristics. As will be discussed below in more detail, fiberglass loose-fill insulation with a density of about 0.46 lbs./ft$^3$ may have an R-value of about 2.3 R/inch (R value per inch thickness of insulation). While this is often sufficient, it is sometimes desirable to have increased R-values per inch thickness for loose-fill insulation.

In view of the above, it will be appreciated by those skilled in the art that there exists a need to improve R-values and/or radiant barrier characteristics of fiberglass based insulation products.

BRIEF SUMMARY OF EXAMPLES OF THE INVENTION

Certain example embodiments of this invention relate to insulation (e.g., loose-fill insulation which may be blown into attics, wall cavities, or the like) comprising a mixture of fiberglass and cellulose. In certain example embodiments of this invention, the insulation mixture comprises from 15-60% cellulose, more preferably from 20-50% cellulose, and most preferably from 25-45% cellulose (with substantially the remainder of the insulation be made up of fiberglass). Thus, the insulation mixture may comprise from 40-85% fiberglass, more preferably from 50-80% fiberglass, and most preferably from 55-75% fiberglass. Other materials (e.g., dedusting oil, anti-static agents, silicone, etc.) in small or other amounts may also be present in certain example embodiments of this invention.

Surprisingly, it has been found that the addition of certain amounts of cellulose to fiberglass-based insulation results in an insulation product with significantly improved radiant barrier and/or R-value properties.

In certain example embodiments of this invention, there is provided a loose-fill insulation mixture comprising: a mixture comprising fiberglass and cellulose, where the mixture comprises from about 15-60% cellulose and from about 40-85% fiberglass; and wherein the loose-fill insulation has an R-value/inch of at least about 2.4 when blown dry into and/or onto an area including a flat supporting surface.

In other example embodiments of this invention, there is provided an insulation mixture comprising a mixture comprising fiberglass and cellulose, where the mixture has an R-value/inch of at least about 2.5 when blown dry into and/or onto an area including a flat supporting surface.

In other example embodiments of this invention, there is provided an insulation mixture comprising: a mixture comprising fiberglass and cellulose, and wherein the mixture comprises from about 15-70% cellulose and from about 30-85% fiberglass.

In other example embodiments of this invention, there is provided a method of installing a loose-fill insulation mixture, the method comprising: providing an insulation mixture comprising fiberglass and cellulose, where the mixture comprises from about 15-60% cellulose and from about 40-85% fiberglass; and blowing the loose-fill mixture comprising fiberglass and cellulose into an attic or vertical wall cavity.

DETAILED DESCRIPTION OF EXAMPLE EMBODIMENTS OF THE INVENTION

Figure 1:
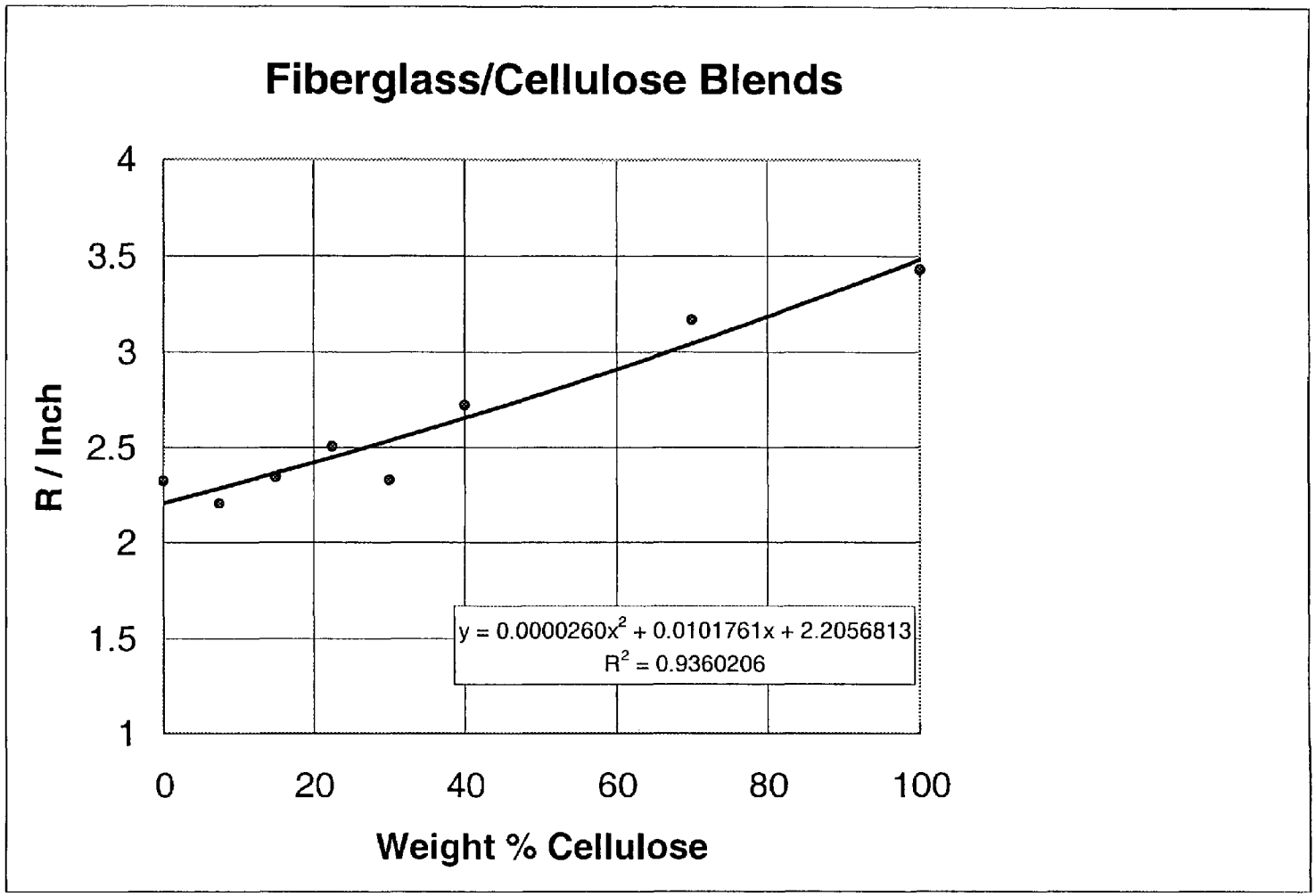
FIG. 1 is a graph illustrating data from various fiberglass/cellulose blends according to different embodiments of this invention.

Certain example embodiments of this invention relate to insulation (e.g., loose-fill insulation which may be blown into attics, wall cavities, or the like) comprising a mixture of fiberglass and cellulose. Cellulose is typically whitish and/or grayish in color, and flakes or fibers thereof can function as radiant barriers.

Fiberglass is a well known insulation material, and typically includes at least about 60% silicon dioxide or the like in known amounts. For example, see U.S. Pat. Nos. 6,012,263, 5,961,686, and 5,952,418, the disclosures of which are hereby incorporated herein by reference.

Cellulose insulation is also known in the art. Cellulose insulation is an organic based insulating material including wood fibers which original from wood products such as newspaper, Kraft paper, cardboard, and/or the like. Cellulose is often known as recycled paper and/or wood based product. However, the use of cellulose alone can be problematic in that blowing it dry creates significant dust during installation, and is also prone to significant settling over time.

Surprisingly, it has been found that the addition of certain amounts of cellulose to fiberglass-based insulation results in an insulation product with significantly improved radiant barrier and/or R-value properties. It is believed that the increase in density caused by the addition of the cellulose, and/or the radiant barrier properties of cellulose due to its coloration and/or fiber shape (which is flake-like in certain instances), permit these characteristics to occur. For example, in certain example embodiments of this invention, an amount of cellulose is provided in a fiberglass-based insulation product so that the resulting product has an R-value/inch which is at least 5% higher than that of 100% fiberglass, more preferably at least 7% higher, even more preferably at least 10% higher, still more preferably at least 12% higher, and most preferably at least 15% higher. For example, if the R-value/inch increases from 2.318 (100% fiberglass) to 2.504 (e.g., 22.5% cellulose, 77.5% fiberglass), this translates into an increase of 8%.

In certain example embodiments of this invention, the insulation mixture comprises from about 15-70% cellulose, more preferably from about 15-60% cellulose, more preferably from about 20-50% cellulose, and most preferably from about 25-45% cellulose (with substantially the remainder of the insulation be made up of fiberglass). Thus, the insulation mixture may comprise from about 30-85% fiberglass, more preferably from about 40-85% fiberglass, more preferably from about 50-80% fiberglass, and most preferably from about 55-75% fiberglass. Other materials in small amounts may also be present in certain example embodiments of this invention. If the amount of cellulose is significantly less than 15%, this has been found to be undesirable in that the R-value/inch does not increase sufficiently to warrant capital expenditure on cellulose introducing and/or manufacturing equipment. On the other hand, if the amount of cellulose in the mixture becomes to great, this is undesirable in that dust generated during installation can increase to too great of an amount and/or settling can become a problematic issue. Thus, it has been found that the cellulose ranges set forth above are the most beneficial and provide for unexpected results of improved R-values/in without significant undesirable increases in dust generation during installation.

In certain example embodiments of this invention, fiberglass inclusive insulation is provided (with cellulose included) so as to have an R-value/inch (per inch thickness) of at least about 2.4 R/inch, more preferably of at least about 2.5 R/inch, even more preferably of at least about 2.6 R/inch, and most preferably of at least 2.7 R/inch. In certain example embodiments, such R-values/inch may be obtained when the insulation mixture is blown dry using conventional blowing equipment into an area having at least a flat supporting surface such as into an area of an attic floor or attic floor cavity between beams. In certain example embodiments, the mixture may have an initial density after blowing of from 0.55 to 1.25 lbs./ft$^3$, more preferably from 0.60 to 1.20 lbs./ft$^3$, even more preferably from about 0.60 to 1.0 lbs./ft$^3$, and most preferably from 0.60 to 0.80 lbs./ft$^3$.

While the insulation mixture according to certain embodiments of this invention described herein is for use in loose-fill insulation to be blown into attics, wall cavities, or the like, this invention is not so limited unless expressly claimed.

EXAMPLES

The Examples set forth below (results shown in FIG. 1) illustrate the surprising benefits associated with certain mixtures of fiberglass and cellulose according to certain embodiments of the instant invention. These examples are provided for purposes of example only, and are not intended to be limiting. For each of the samples set forth below, a plurality of different examples was made and the resulting average properties are listed. For example, a plurality of samples with 22.5% cellulose (remainder fiberglass) were made and the average of all such samples with this amount of cellulose was an R-value/inch of 2.50 and a density of 0.61 lb./ft$^3$. For the below loose-fill examples, the fiberglass used was white uncured loose-fill fiberglass from Guardian Fiberglass, Inc., Albion, Mich., and the cellulose was residential loose-fill cellulose from P-K Cellulose, Joplin, Mo. and/or Cocoon cellulose from the U.S. Greenfiber, Charlotte, N.C. As mentioned above, the insulation in the mixtures of loose-fill for the below examples not in the form of cellulose was fiberglass (e.g., 22.5% cellulose translates also into 77.5% fiberglass).

| Samples | % Cellulose | R-value/inch | Density (lb./ft$^3$) |
|---|---|---|---|
| 1 | 0 | 2.32 | 0.48 |
| 2 | 7.5 | 2.20 | 0.52 |
| 3 | 15 | 2.34 | 0.53 |

-continued

| Samples | % Cellulose | R-value/inch | Density (lb./ft$^3$) |
|---|---|---|---|
| 4 | 22.5 | 2.50 | 0.61 |
| 5 | 30 | 2.33 | 0.57 |
| 6 | 40 | 2.72 | 0.76 |
| 7 | 70 | 3.17 | 1.17 |
| 8 | 100 | 3.43 | 1.69 |

FIG. 1 plots the averages of these examples set forth above, illustrating that R-value/inch (per inch thickness as deposited on a flat surface as blown dry) increases with additional cellulose in the insulation mixture.

As can be seen from the above, the examples with cellulose added to the fiberglass were surprisingly able to realize a combination of improved R-values/inch and satisfactory lack of dust generation during installation. Moreover, the fire retardant properties of fiberglass are also taken advantage of in this respect: For example, examples with a mixture of 40% cellulose and thus 60% fiberglass realized an average R-value/inch of 2.72, which is a an approximate 17% increase in R-value/inch over 100% fiberglass (0% cellulose). This is a significant and unexpected improvement in the art.

Moreover, it is also noted that even though such examples with 40% cellulose added to fiberglass realize significantly improved R-values/inch compared to 100% fiberglass loose-fill, they are also often less expensive to manufacture in view of cheaper prices of cellulose which often occur thereby leading to yet another advantage associated with certain example embodiments of this invention. Still another example advantage associated with certain embodiments of this invention is that a fiberglass manufacturer's output can be increased without increasing its fiberglass production capabilities (i.e., less fiberglass is need for more insulation product, due to the addition of certain amounts of cellulose to the insulation which results in less fiberglass being required).

While aforesaid examples and embodiments envision blowing the insulation mixture dry or substantially dry, this invention is not so limited. For example, water may be added to the mixture for spraying and/or blowing purposes in certain example embodiments of this invention.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

The invention claimed is:

1. Loose-fill insulation mixture consisting essentially of from about 15-60% cellulose and from about 40-85% fiberglass; and wherein the loose-fill insulation has an R-value/inch of at least about 2.4 when blown dry into and/or onto an area including a flat supporting surface.

2. The loose-fill insulation of claim 1, wherein the cellulose is present in an amount of from about 20-50%.

3. The loose-fill insulation of claim 1, wherein the cellulose is present in an amount of from about 25-45%.

4. The loose-fill insulation of claim 1, wherein the mixture has an R-value/inch of at least about 2.5.

5. The loose-fill insulation of claim 1, wherein the mixture has an R-value/inch of at least about 2.6.

6. The loose-fill insulation of claim 1, wherein the mixture has an R-value/inch of at least about 2.7.

7. The loose-fill insulation of claim 1, wherein the mixture has an initial density of from 0.55 to 1.25 lbs./$ft^3$.

8. The loose-fill insulation of claim 1, wherein the mixture has an initial density of from 0.6 to 0.8 lbs./$ft^3$.

9. The loose-fill insulation of claim 1, wherein the cellulose in the mixture increases the R-value/inch of the mixture by at least 5% for a given density of the mixture, compared to 100% loose-fill fiberglass insulation.

10. A method of installing a loose-fill insulation mixture, the method comprising: providing an insulation mixture consisting essentially of from about 15-60% cellulose and from about 40-85% fiberglass; and blowing and/or spraying the loose-fill insulation mixture into an attic or vertical wall cavity.

* * * * *